US007287936B2

(12) United States Patent
Streiff et al.

(10) Patent No.: US 7,287,936 B2
(45) Date of Patent: Oct. 30, 2007

(54) SHALLOW WATER RISER CONFIGURATION

(76) Inventors: Jean Luc Streiff, 560 Rancho Bauer, Houston, TX (US) 77079; Jeroen Remery, 11510 Olympia Dr., Houston, TX (US) 77077; Mathieu Boisne, 3354 Rogerdale Rd., Apt. 738, Houston, TX (US) 77042

( * ) Notice: Subject to any disclaimer, the term of this patent is extended or adjusted under 35 U.S.C. 154(b) by 0 days.

(21) Appl. No.: 11/326,695

(22) Filed: Jan. 6, 2006

(65) Prior Publication Data

US 2006/0159521 A1 Jul. 20, 2006

Related U.S. Application Data

(60) Provisional application No. 60/642,086, filed on Jan. 7, 2005.

(51) Int. Cl.
*F16L 1/14* (2006.01)

(52) U.S. Cl. ..... 405/224.2; 405/171; 405/172; 166/350

(58) Field of Classification Search ..... 405/171, 405/172, 224.2; 166/350
See application file for complete search history.

(56) References Cited

U.S. PATENT DOCUMENTS

| | | | | |
|---|---|---|---|---|
| 4,135,844 | A * | 1/1979 | Lamy | 405/171 |
| 4,183,697 | A * | 1/1980 | Lamy | 405/170 |
| 4,263,004 | A * | 4/1981 | Joubert et al. | 405/172 |
| 5,275,510 | A * | 1/1994 | de Baan et al. | 405/171 |
| 5,437,518 | A * | 8/1995 | Maloberti et al. | 405/169 |
| 6,030,145 | A * | 2/2000 | Stewart et al. | 405/172 |
| 6,146,052 | A * | 11/2000 | Jacobsen et al. | 405/169 |

* cited by examiner

*Primary Examiner*—Frederick L. Lagman
(74) *Attorney, Agent, or Firm*—Ostrolenk, Faber, Gerb & Soffen, LLP

(57) ABSTRACT

A shallow water riser extending between a seabed connection and a floating support connection and of a length through the shallow water to be in wave form with at least one and, as illustrated, two wave areas in contact with the seabed. A protective sheath optionally surrounds the riser at the contact regions with the seabed. The upraised wave portions are supported by float elements.

5 Claims, 1 Drawing Sheet

SHALLOW WATER RISER CONFIGURATION

CROSS-REFERENCE TO RELATED APPLICATION

The present application claims the benefit and priority of U.S. Provisional Application No. 60/642,086 filed Jan. 7, 2006 and entitled SHALLOW WATER RISER CONFIGURATION, the entire disclosure of which is incorporated by reference herein.

BACKGROUND OF THE INVENTION

The configuration of a flexible riser is extremely challenging in view of several factors including the very shallow water depth, the important offset of the vessel, the specification on the marine growth may oblige designing the configuration for two different apparent weights of the flexible riser, the restriction on the FSO structures, the requirement for perhaps 25 years of service life, and the number of the risers used.

The riser configuration proposed is installed in a water depth which is smaller than 100 m and advantageously smaller than 50 meter. No other FSO (even in Nigeria) with flexible risers connected on the sea bed has been installed in such shallow effective water depth (that is, the water depth minus the maximum draft of the vessel) combined with such extreme offset and draft change.

SUMMARY OF THE INVENTION

Based on Applicants' unique experience, they conclude that, with the actual basic connection point (front of FSO and subsea PLEM) the safer solution is to accept some interaction between the flexible pipe riser and the sea bed. Therefore, the configuration of the flexible riser between the floater support (FSO) and the seabed installation (manifold, wellhead, PLEM) comprises at least a double wave shape or "camel" shape. Furthermore, at least one of the waves has a bottom part which touches the seabed. Depending on the movement of the FSO (floating support), the bottom parts of two (or more) of the waves could be in contact with the seabed. Also it is possible to have more than two "waves" if there is need for that depending on the configuration of the field.

Contact with soil by any flexible riser occurs at the touch down point. Applicants' developed methods to estimate the loads created by this contact and to confirm the suitability of the flexible riser.

In order to avoid any issue with wear, even when the soil is of soft clay or another soft material, the areas of the flexible riser which will be in contact with the sea bed may be protected by an external outer sheath protection. This protection could be of uraduct type for example. This material has an impressive track record for flexible and umbilical protection.

To provide the wave form, the upper curve of the wave may be held up by float elements.

Applicants recommend that divers' surveys be carried out on a regular basis, for instance every six months or after a significant storm, and that the uraduct be replaced as needed.

Other features and advantages of the present invention will become apparent from the following description of the invention which refers to the accompanying drawings.

DETAILED DESCRIPTION OF AN EMBODIMENT OF THE INVENTION

Figure 1:
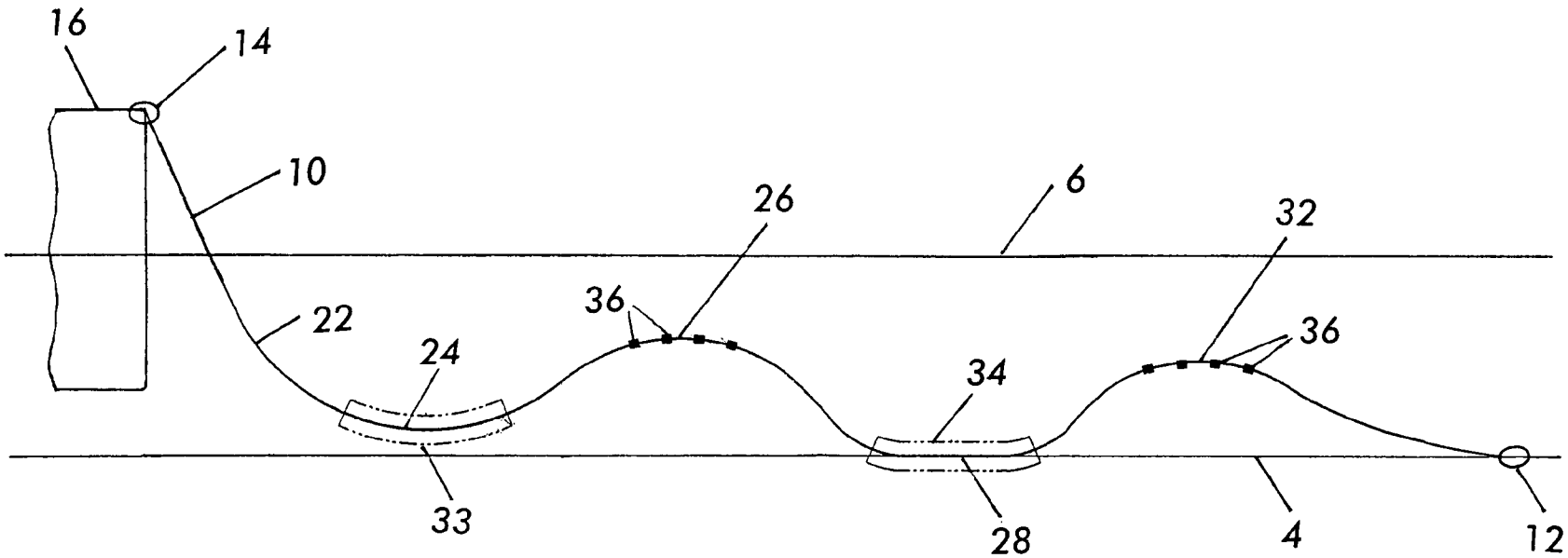
FIG. 1 shows a flexible riser according to the invention.

Referring to FIG. 1, there is a seabed 4 with water on the seabed up to the water level 6. The depth of the water in which the visor is disposed is not specified except that it would be shallow for use of risers. For example, the distance between the seabed 4 and the water level is perhaps 25 meters in height in this example in FIG. 1 but may be up to 50 m or 100 m. The riser 10 is a flexible shallow water riser, that is a pipe, for fluid extracted from beneath the seabed, and particularly maybe a hydrocarbon, like oil or even gas. There is a connection 12 over the riser to the seabed and a connection 14 of the riser to a floating support 16. Such floating supports are known in the art.

Because of the considerable lateral distance between the connection 14 to the floating support and the connection 12 to the seabed, as compared with the water depth, the riser extends a considerable distance laterally as compared with the distance it extends up to the connection 14.

In the preferred form of riser 10 illustrated, the riser 10 has a double wave shape, sometimes referred to as a "camel" shape, which includes a portion 22 extending down from the connection 14 to a first bottom seabed contacting region 24, a first wave rise to a first peak region at 26, a second downward part to a second seabed contacting area at 28 to a second peak area 32 and then descending to the connection 12.

In FIG. 1, both of the downward portions of the wave have a the seabed contact areas. The floating object 16 and/or the length of the riser 10 may be selected so that there is contact between only one wave bottom and the seabed. If the riser 10 were longer or to handle a particular application, the riser 10 might include more than two of the illustrated waves.

As noted above, the areas of the flexible riser in contact with the seabed may be protected by a short external sheath 32 at which would be at the region 24 and another external sheath at the contacting area 28. The sheath would be of the uraduct type.

To hold the peaks of the riser up, it is contemplated to provide floating nodules 36 there.

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

What is claimed is:

1. A shallow water riser for extending beneath a sea and above a seabed between a connection at the seabed and a connection to a floating support, the shallow water riser having a wave form between the seabed connection and the floating support connection, which is shaped, is of such length and is positioned to include at least two riser wave parts in succession, each of the two riser wave parts including a respective lower wave part toward the seabed, followed by a crest away from the seabed, one of the crests being between the two lower wave parts, at least one of the lower wave parts being positioned to be in contact with the seabed and the shallow water riser being of such length to enable such contacts and crests.

2. The shallow water riser of claim 1, wherein there are at least two of the lower wave parts of the riser in contact with the seabed.

3. The shallow water riser of claim 1, further comprising two respective protective outer sheaths around the riser, positioned at each of the two lower wave parts which may contact the seabed.

4. The shallow water riser of claim 3, wherein the two protective outer sheaths are positioned around the riser only at a lower region of the lower wave part.

5. The shallow water riser of claim 1, further comprising floating elements operable to hold up the crest of each of the two riser wave parts.

* * * * *